US008905575B2

(12) United States Patent
Durkee et al.

(10) Patent No.: US 8,905,575 B2
(45) Date of Patent: Dec. 9, 2014

(54) TROFFER-STYLE LIGHTING FIXTURE WITH SPECULAR REFLECTOR

(75) Inventors: John Durkee, Raleigh, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 108 days.

(21) Appl. No.: 13/370,252

(22) Filed: Feb. 9, 2012

(65) Prior Publication Data

US 2013/0208457 A1 Aug. 15, 2013

(51) Int. Cl.
*F21V 29/00* (2006.01)
*F21V 7/20* (2006.01)

(52) U.S. Cl.
USPC ..... 362/218; 362/345; 362/547; 362/249.02

(58) Field of Classification Search
USPC ..... 362/249.01, 249.02, 294, 218, 545, 362/547, 345
See application file for complete search history.

(56) References Cited

U.S. PATENT DOCUMENTS

| | | | | |
|---|---|---|---|---|
| D85,382 | S | 10/1931 | Guth | D26/24 |
| 5,025,356 | A | 6/1991 | Gawad | 362/221 |
| 5,823,663 | A | 10/1998 | Bell et al. | 362/362 |
| D407,473 | S | 3/1999 | Wimbock | D23/328 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,443,598 | B1 | 9/2002 | Morgan | 362/342 |
| 6,523,974 | B2 | 2/2003 | Engel | 362/224 |
| D496,121 | S | 9/2004 | Santoro | D26/74 |
| 6,871,983 | B2 | 3/2005 | Jacob et al. | 362/364 |
| 6,948,840 | B2 * | 9/2005 | Grenda et al. | 362/555 |
| 7,021,797 | B2 | 4/2006 | Minano et al. | 362/355 |
| 7,049,761 | B2 | 5/2006 | Timmermans et al. | 315/246 |
| 7,213,940 | B1 | 5/2007 | Van de Ven et al. | 362/231 |
| 7,237,924 | B2 | 7/2007 | Martineau et al. | 362/231 |

(Continued)

FOREIGN PATENT DOCUMENTS

| | | |
|---|---|---|
| CN | 101188261 | 5/2008 |
| CN | 202580962 | 12/2012 |

(Continued)

OTHER PUBLICATIONS

US Publication No. US 2007/0115671, date: May 24, 2007 to Roberts et al.

(Continued)

*Primary Examiner* — Ali Alavi
(74) *Attorney, Agent, or Firm* — Koppel, Patrick, Heybl & Philpott

(57) ABSTRACT

An indirect troffer-style lighting fixture that is particularly well-suited for use with solid state light sources. An elongated heat sink with a mount surface for light sources runs longitudinally along the fixture. To facilitate heat dissipation, a portion of the heat sink is exposed to the ambient room environment. An elongated specular reflector also runs along the device proximate to the heat sink. The heat sink and the specular reflector are mounted such that a spatial relationship is maintained. Some of the light from the sources impinges directly on the specular reflector and is redirected towards a back surface. The back surface defines a luminous surface that receives light directly from the sources and redirected light from the specular reflector. The back surface and the heat sink mechanically obscure any images of the light sources in the specular reflector such that they are not visible in a viewing area.

31 Claims, 7 Drawing Sheets

(56) References Cited

U.S. PATENT DOCUMENTS

| | | | | |
|---|---|---|---|---|
| D556,358 | S | 11/2007 | Santoro | D26/74 |
| 7,338,182 | B1 | 3/2008 | Hastings et al. | 362/150 |
| 7,510,299 | B2 | 3/2009 | Timmermans et al. | 362/225 |
| 7,520,636 | B2 | 4/2009 | Van der Poel | 362/290 |
| D593,246 | S | 5/2009 | Fowler et al. | D26/76 |
| 7,594,736 | B1 | 9/2009 | Kassay et al. | 362/223 |
| D604,446 | S | 11/2009 | Fowler et al. | D26/76 |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,702 | B1 * | 2/2010 | Ding et al. | 362/294 |
| 7,661,844 | B2 | 2/2010 | Sekiguchi et al. | 362/249 |
| D611,183 | S | 3/2010 | Duarte | D26/76 |
| 7,674,005 | B2 | 3/2010 | Chung et al. | 362/223 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van de Ven | 362/294 |
| D617,487 | S | 6/2010 | Fowler et al. | D26/76 |
| 7,768,192 | B2 | 8/2010 | Van de Ven et al. | 313/503 |
| 7,815,338 | B2 | 10/2010 | Siemiet et al. | 362/218 |
| 7,828,468 | B2 | 11/2010 | Mayfield et al. | 362/342 |
| D633,247 | S * | 2/2011 | Kong et al. | D26/88 |
| 7,988,321 | B2 | 8/2011 | Wung et al. | 362/218 |
| 7,988,335 | B2 * | 8/2011 | Liu et al. | 362/294 |
| 7,997,762 | B2 | 8/2011 | Wang et al. | 362/249 |
| 8,070,326 | B2 | 12/2011 | Lee | 362/307 |
| D653,376 | S | 1/2012 | Kong et al. | D26/76 |
| 8,092,049 | B2 | 1/2012 | Kinnune et al. | 362/294 |
| 8,162,504 | B2 | 4/2012 | Zhang et al. | 362/217 |
| 8,186,855 | B2 | 5/2012 | Wassel et al. | 362/373 |
| 8,201,968 | B2 | 6/2012 | Maxik et al. | |
| 8,215,799 | B2 | 7/2012 | Vanden Eynden et al. | 362/294 |
| 8,256,927 | B2 | 9/2012 | Hu et al. | 362/294 |
| 8,317,354 | B2 | 11/2012 | Gassner et al. | 362/147 |
| 8,480,252 | B2 | 7/2013 | Bertram et al. | 362/243 |
| 8,506,135 | B1 | 8/2013 | Oster | 362/373 |
| 8,591,071 | B2 | 11/2013 | Hochstein | 362/294 |
| 2004/0001344 | A1 * | 1/2004 | Hecht | 362/555 |
| 2005/0264716 | A1 | 12/2005 | Kim et al. | |
| 2006/0262521 | A1 | 11/2006 | Piepgras et al. | 362/149 |
| 2007/0109779 | A1 | 5/2007 | Sekiguchi et al. | |
| 2007/0211457 | A1 * | 9/2007 | Mayfield et al. | 362/223 |
| 2007/0253205 | A1 | 11/2007 | Welker | 362/373 |
| 2007/0297181 | A1 | 12/2007 | Mayfield et al. | 362/342 |
| 2008/0049422 | A1 | 2/2008 | Trenchard et al. | 362/238 |
| 2008/0232093 | A1 | 9/2008 | Steven | |
| 2008/0278943 | A1 | 11/2008 | Van der Poel | 362/240 |
| 2009/0196024 | A1 | 8/2009 | Heiking et al. | 362/150 |
| 2009/0237958 | A1 | 9/2009 | Steven | |
| 2009/0262543 | A1 | 10/2009 | Ho | 362/373 |
| 2009/0310354 | A1 | 12/2009 | Zampini et al. | 362/235 |
| 2010/0097794 | A1 | 4/2010 | Teng et al. | 362/231 |
| 2010/0110679 | A1 | 5/2010 | Teng et al. | |
| 2010/0172133 | A1 * | 7/2010 | Liu | 362/235 |
| 2010/0188609 | A1 | 7/2010 | Matsuki et al. | |
| 2010/0254128 | A1 | 10/2010 | Pickard et al. | |
| 2010/0254145 | A1 | 10/2010 | Yamaguchi | |
| 2010/0254146 | A1 | 10/2010 | McCanless | |
| 2010/0295468 | A1 | 11/2010 | Pederson et al. | 315/294 |
| 2011/0032714 | A1 | 2/2011 | Chang | 362/373 |
| 2011/0043132 | A1 * | 2/2011 | Kim et al. | 315/294 |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li et al. | 362/235 |
| 2011/0156584 | A1 | 6/2011 | Kim | |
| 2011/0199005 | A1 | 8/2011 | Bretschneider et al. | |
| 2011/0199769 | A1 | 8/2011 | Bretschneider et al. | |
| 2011/0267810 | A1 | 11/2011 | Higman et al. | 362/218 |
| 2012/0038289 | A1 | 2/2012 | Jee et al. | |
| 2012/0051041 | A1 | 3/2012 | Edmond et al. | |
| 2012/0127714 | A1 | 5/2012 | Rehn | |
| 2012/0140464 | A1 | 6/2012 | Huang et al. | |

FOREIGN PATENT DOCUMENTS

| | | | |
|---|---|---|---|
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| JP | 2002244027 | | 11/2002 |
| JP | 03097327 | | 8/2003 |
| JP | 2004140327 | | 5/2004 |
| JP | 2009295577 | | 12/2009 |
| JP | 2010103687 | | 5/2010 |
| JP | 2011018571 | | 8/2011 |
| JP | 2011018572 | | 8/2011 |
| WO | WO 03102467 | | 12/2003 |
| WO | WO 2009140761 | A1 | 11/2009 |
| WO | WO 2009157999 | A1 | 12/2009 |
| WO | WO 2010042216 | | 4/2010 |
| WO | WO 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |

OTHER PUBLICATIONS

US Publication No. US 2007/0115670, date: May 24, 2007 to Roberts et al.
US Publication No. US 2009/0323334, date: Dec. 31, 2009 to Roberts et al.
US Publication No. US 2009/0225543, date: Mar. 5, 2008 to Roberts et al.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16.
Cree's XLamp XP-G LED's, data sheet, pp. 1-12.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25. 2013.
International Search Report and Written Opinion for PCT Application No. PCT/US2011/062396, dated Jul. 13, 2012.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion for Patent Application No. PCT/US2011/001517, dated: Feb. 27, 2012.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/U52013/035668, dated Jul. 12, 2013.
Preliminary Report and Written Opinion from PCT appl. No. PCT/US2012/047084, dated Feb. 6, 2014.
International Search Report and Written Opinion from PCT Application No. PCT/US2013/021053, dated Apr. 17, 2013.
Office Action from U.S. Appl. No. 13/429,080, dated Apr. 18, 2014.
Office Action from U.S. Appl. No. 12/961,385, dated Mar. 11, 2014.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.

(56) References Cited

OTHER PUBLICATIONS

International Search Report and Written Opinion from Appl. No. PCT/CN2013/072772, dated Dec. 19, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
International Search Report and Written Opinion from PCT/US2013/049225, dated Oct. 24. 2013.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745. dated Jul. 16, 2014.
International Preliminary Report on Patentability and Written Opinion from PCT/US2013/021053, dated Aug. 21, 2014.

* cited by examiner

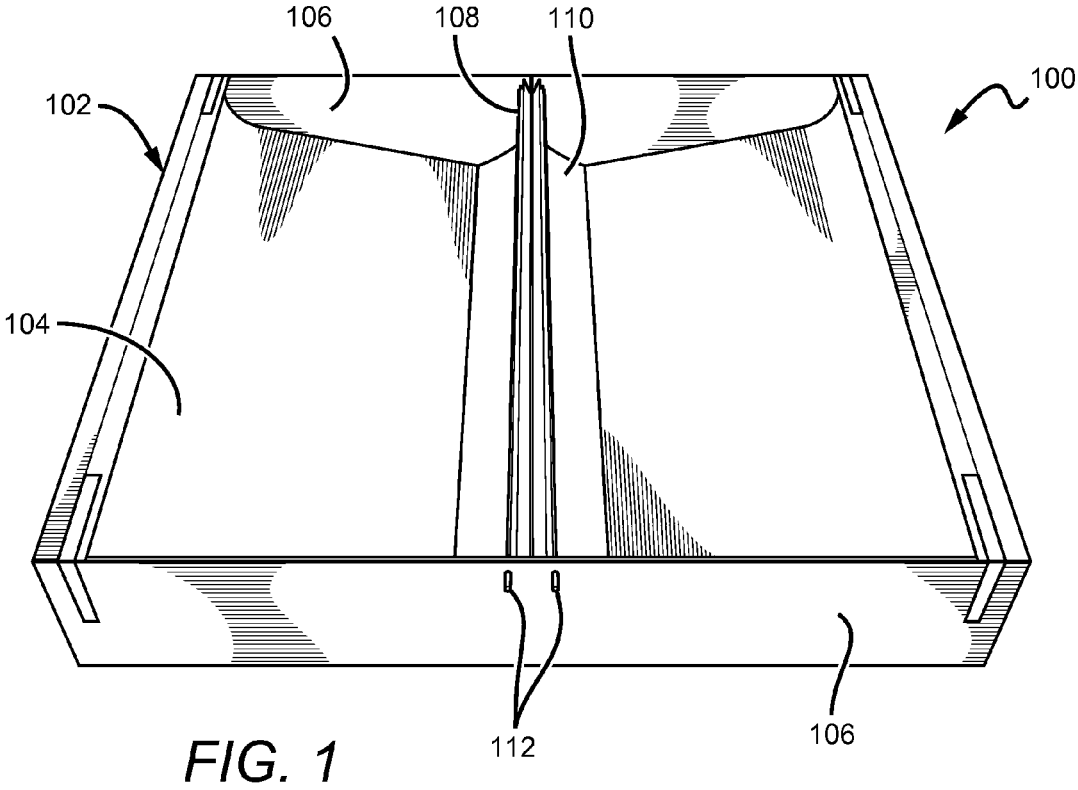
FIG. 1
FIG. 2
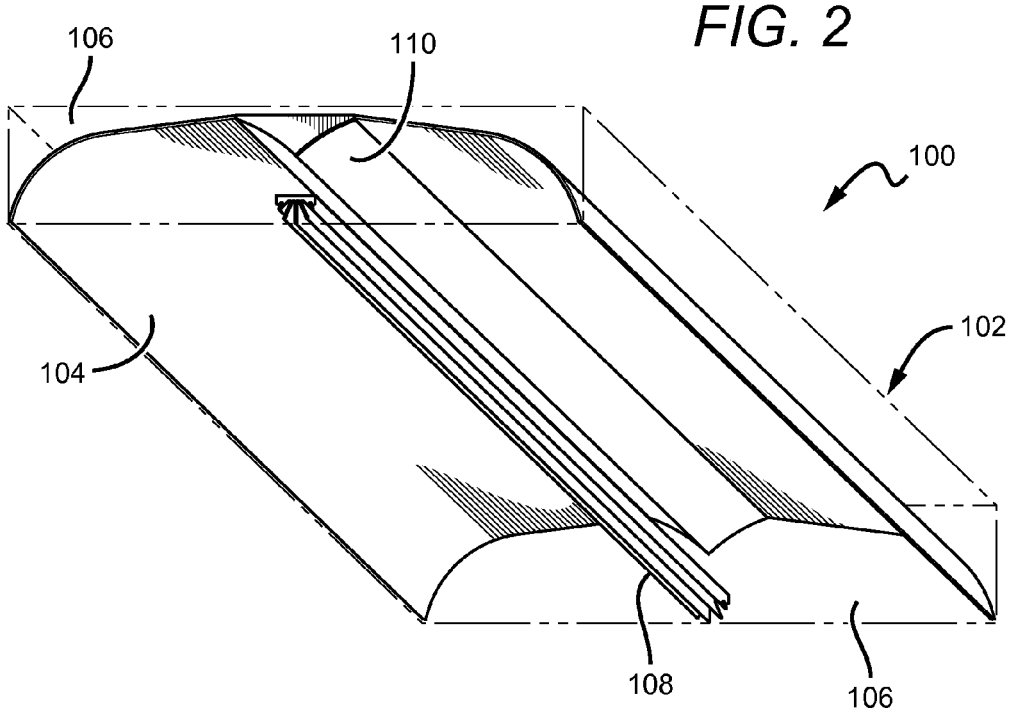

FIG. 6a
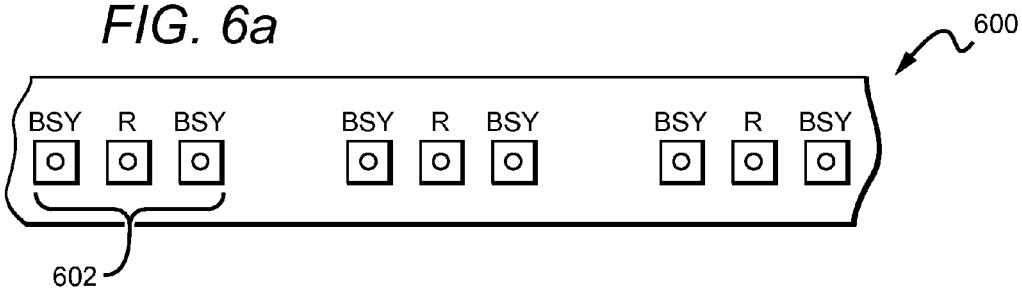
FIG. 6b
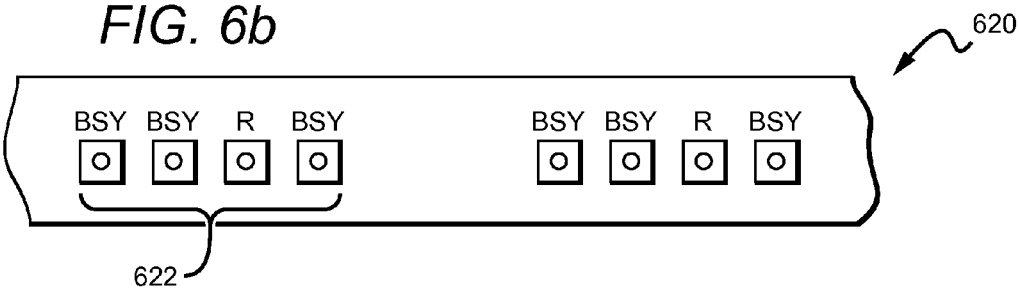
FIG. 6c
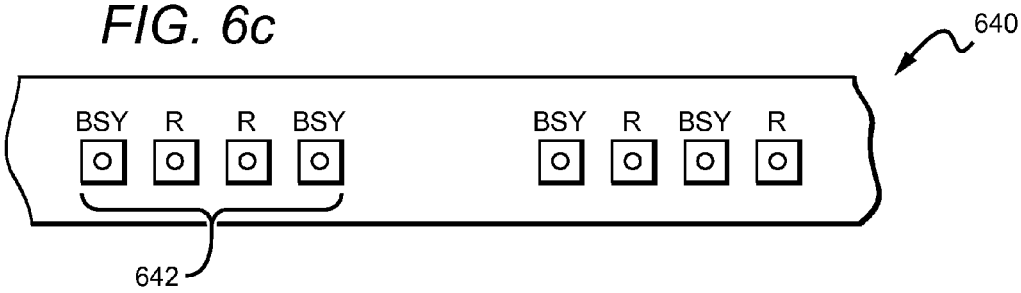
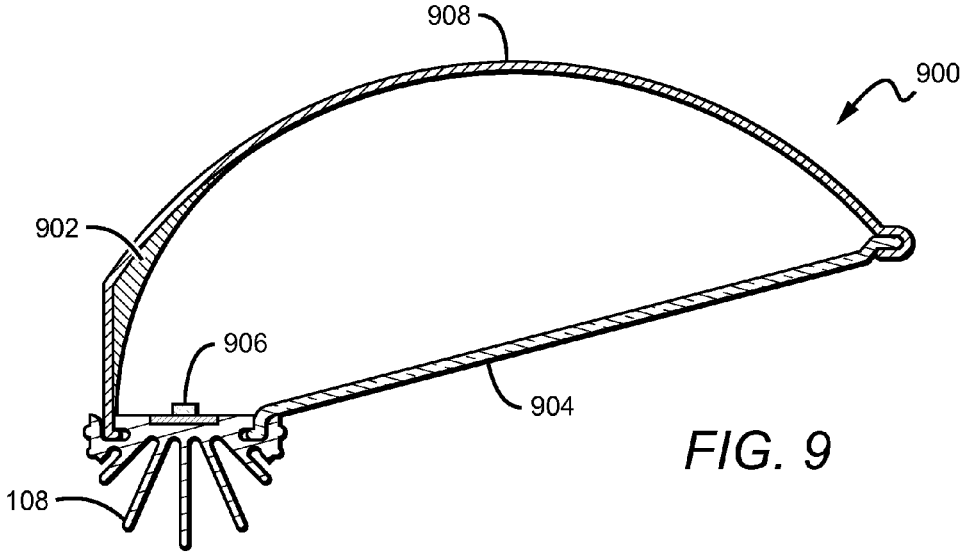
FIG. 9

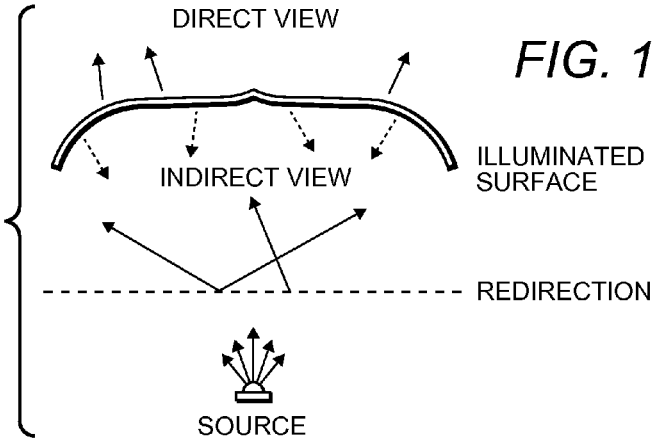
FIG. 13a
FIG. 13b
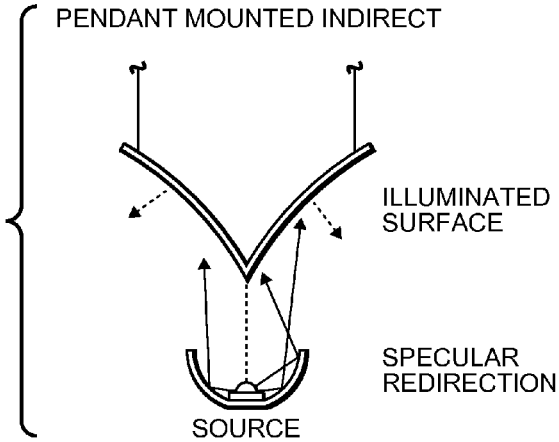
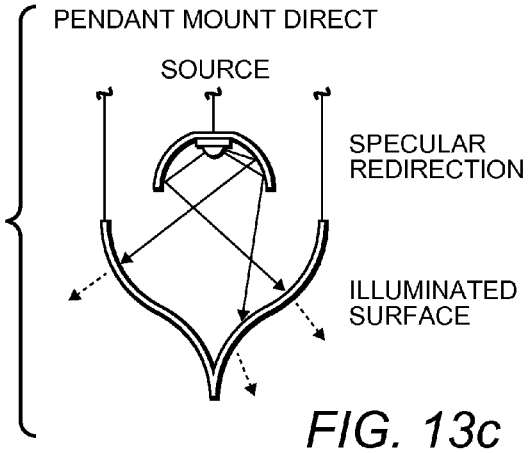
FIG. 13c

TROFFER-STYLE LIGHTING FIXTURE WITH SPECULAR REFLECTOR

BACKGROUND OF THE INVENTION

1. Field of the Invention

The invention relates to lighting troffers and, more particularly, to indirect, direct, and direct/indirect lighting troffers that are well-suited for use with solid state lighting sources, such as light emitting diodes (LEDs).

2. Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures. Another example of a troffer-style fixture is U.S. patent application Ser. No. 11/961,385 to Pickard, which is commonly assigned with the present application and incorporated by reference herein.

More recently, with the advent of efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate, or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "down-converts" some of the blue light, changing it to yellow light. Some of the blue light passes through the phosphor without being changed while a substantial portion of the light is down-converted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. Examples of indirect fixtures can be found in U.S. Pat. No. 7,722,220 to Van de Ven and U.S. patent application Ser. No. 12/873,303 to Edmond et al., both of which are commonly assigned with the present application and incorporated by reference herein.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

Embodiments of a lighting fixture comprise the following elements. An elongated heat sink comprises a mount surface. An elongated specular reflector is proximate to the mount surface, the heat sink and the specular reflector arranged such that a spatial relationship is maintained between the heat sink and the specular reflector. A back surface is proximate to the elongated specular reflector.

Embodiments of a lighting assembly comprise the following elements. A protective housing comprises at least one end piece and a back surface. An elongated heat sink is mounted to the at least one end piece, the heat sink comprising a mount surface. An elongated specular reflector is on said back surface, such that a spatial relationship is established between the specular reflector and the heat sink. At least one light source is on said mount surface. A control circuit is included for controlling the at least one light source.

Embodiments of a method of lighting a surface includes the following steps presented in no particular order. Light is emitted from a light source over a range of angles. At least a portion of the light is redirected with a specular reflector toward a luminous surface. Light is received directly from the light source and from the specular reflector at the luminous surface. Images of the light source on the specular reflector are mechanically obscured from a viewing area.

BRIEF DESCRIPTION OF THE DRAWINGS

FIG. 1 is a perspective view of a lighting fixture according to an embodiment of the present invention.

FIG. 2 is a perspective view of a light fixture according to an embodiment of the present invention, shown with portions of a housing and end pieces shown in phantom to better illustrate the internal components.

FIGS. 6*a-c* show a top view of portions of several light strips that may be used in embodiments of the present invention.

FIG. 9 is a cross-sectional view of a lighting fixture according to an embodiment of the present invention.

FIGS. 13*a-f* show several cross-sectional views of fixture arrangements according to embodiments of the present invention.

DETAILED DESCRIPTION OF THE INVENTION

Figure 3:
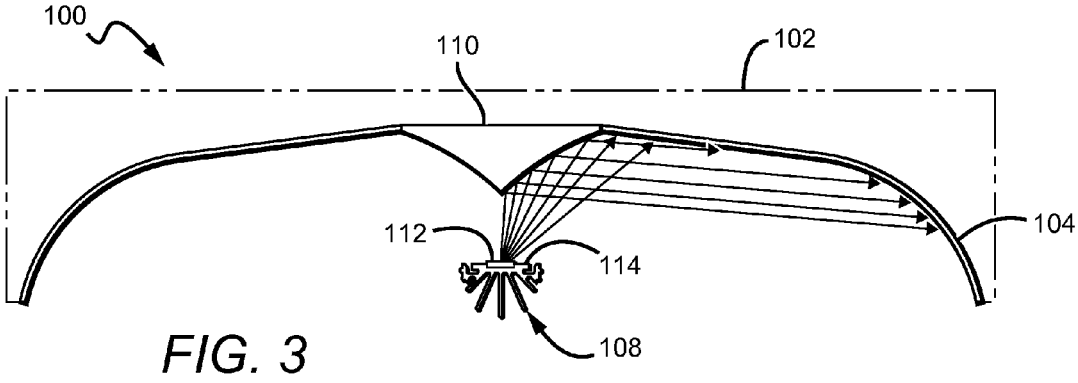
FIG. 3 is a cross-sectional view of a fixture according to an embodiment of the present invention.

Embodiments of the present invention provide troffer-style lighting fixture that is particularly well-suited for use with solid state light sources, such as LEDs, for example. An elongated heat sink with a mount surface for light sources runs longitudinally along the spine of the fixture. To facilitate heat dissipation, a portion of the heat sink is exposed to the ambient room environment. An elongated specular reflector also runs along the spine of the device and is disposed proximate to the heat sink. The heat sink and the specular reflector are mounted (e.g., to an end piece) such that a spatial relationship is maintained between the elements. Some of the light from the sources impinges directly on the specular reflector and is redirected towards a back surface. The back surface defines an illuminated surface that receives light directly from the sources and redirected light from the specular reflector. The back surface and the heat sink mechanically obscure any images of the light sources in the specular reflector such that they are not visible in a viewing area.

Embodiments of the present invention are designed to efficiently produce a visually pleasing output. Some embodiments are designed to emit with an efficacy of no less than approximately 65 lm/W. Other embodiments are designed to have a luminous efficacy of no less than approximately 76 lm/W. Still other embodiments are designed to have a luminous efficacy of no less than approximately 90 lm/W.

One embodiment of a recessed lay-in fixture for installation into a ceiling space of not less than approximately 4 $ft^2$ is designed to achieve at least 88% total optical efficiency with a maximum surface luminance of not more than 11 $cd/in^2$ with a maximum luminance gradient of not more than 5:1. Total optical efficiency is defined as the percentage of light emitted from the light source(s) that is actually emitted from the fixture. Other similar embodiments are designed to achieve a maximum surface luminance of not more than 8 $cd/in^2$. Still other similar embodiments are designed to achieve a maximum luminance gradient of not more than 3:1. Others are designed to achieve a maximum luminance gradient of not more than 2:1. In these embodiments, the actual room-side area profile of the fixture will be approximately 4 $ft^2$ or greater due to the fact that the fixture must fit inside a ceiling opening having an area of at least 4 $ft^2$ (e.g., a 2 ft by 2 ft opening, a 1 ft by 4 ft opening, etc.).

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual size of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of any elements of a device and are not intended to limit the scope of the invention.

FIG. 1 is a perspective view of a lighting fixture 100 according to an embodiment of the present invention. A protective housing 102 comprises a back surface 104 and end pieces 106, establishing the basic structure of the fixture 100. The housing 102 may be constructed out of many sturdy materials, with one suitable material being aluminum, and may be sized to accommodate many different lighting designs. An elongated heat sink 108 extends between the two end pieces 106. One end of the heat sink 108 is mounted to at least one of the end pieces 106, although it may be mounted to both, such that the heat sink 108 is spaced a distance away from the specular reflector 110. The heat sink 108 comprises a mount surface (not shown in FIG. 1) that faces the back surface 104. A specular reflector 110 is disposed on the back surface 104 proximate to the heat sink 108 such that a spatial relationship is maintained between the two elements. In other embodiments, the specular reflector can be arranged near to the back surface 104, rather than on it. Electrical connections 112 may be disposed at either end of the heat sink to power the light sources mounted thereon. The light sources may be powered with a battery attached to the housing 102 or to an external power source. A control circuit (not shown) is used to provide the correct voltage for the light sources and may also be used to dim one or more of the sources to control the color of the light and the output intensity of the light, for example. The control circuit may be housed externally or may be disposed on a printed circuit board (PCB) on the mount surface of the heat sink 108.

FIG. 2 is a perspective view of the light fixture 100 shown with portions of the housing 102 and the end pieces 106 shown in phantom to better illustrate the internal components. Indeed, if the back surface 104 is sturdy enough to provide mechanical support to the fixture 100, then the housing may not be necessary. As noted, the heat sink 108 is mounted parallel to and spaced a particular distance from the specular reflector 110. The spatial relationship provides a particular light profile including the light directly emitted from the sources and the light that is reflected off of the specular reflector 110. The combined light profile is projected onto a luminous surface (e.g., the back surface 104 in this embodiment). A luminous surface can be any surface that functions as the apparent light source from the perspective of an observer in the lighted area. The light is then redirected from the luminous surface into an area, such as a room, to provide a desirable lighting environment.

Although in FIG. 1, the heat sink is mounted to the end pieces 106, it is understood that the heat sink 108 may be positioned relative to the specular reflector 110 in many different ways. For example, the heat sink 108 may be positioned using stand-off posts or suspension elements so long as the spatial relationship is maintained.

FIG. 3 is a cross-sectional view of the fixture 100. Similarly as in FIG. 2, the optional housing 102 is shown in phantom. A light source 112 (e.g., and LED) is disposed on the mount surface 114 of the heat sink 108. Light from the source 112 is emitted over a range of angles toward both the specular reflector 110 and the back surface 104. Substantially all of the light that impinges the specular reflector 110 is redirected toward the back surface 104. That light is then redirected by the back surface 104 into an area where light is desired, such as a room.

The specular reflector 110 and the luminous surface (here, back surface 104) may be shaped in many ways. In this embodiment, the specular reflector 110 comprises a parabolic mirror which is used to spread the light from the source 112 laterally across the back surface 104. The specular reflector 110 may have a cross-section that is curved, straight, or a combination of both, and may comprise a single reflective element or multiple separate reflective elements. The light reflecting off of the specular reflector 110 should be carefully controlled such that it does not escape the fixture directly as this would create an unpleasant glare for observers in the room. Thus, the back surface 104 must be shaped and arranged to receive substantially all of this light. Like the specular reflector 110, the back surface 104 can be linear, curved, or both, and can comprise a single continuous surface or multiple discreet surfaces. The shape and the arrangement of these elements are interrelated; that is, the shapes of the specular reflector 110 and the back surface 104 will determine their appropriate spatial arrangement, or, vice versa, the arrangement will dictate the shapes. In many cases, it will be desirable to design the specular reflector 110 and the back surface 104 such that light is evenly spread across the entire face of the back surface 104. However, some designs may require distributing the light in a non-uniform pattern across a luminous surface, using an anisotropic reflector, for example. Many combinations are possible to achieve a desired lighting effect.

The specular reflector 110 may be made from many different materials. In one embodiment, the specular reflector 110 comprises a metal body with a silver-coated surface. However, it is understood that many different highly reflective materials/coatings will suffice. Using a specular reflector may provide design advantages over a diffuse reflector or lens to distribute light across a luminous surface, such as the back surface 104. For example, the specular reflector 110 allows the sources to be more distantly spaced out along the heat sink 108 without producing hotspots along the back surface 104. Also, because they can be clustered, fewer sources are necessary to evenly light the entire luminous surface, reducing the overall cost and improving the energy efficiency of the system.

The back surface 104 may comprise many different materials. For many indoor lighting applications, it is desirable to present a uniform, soft light source without unpleasant glare, color striping, or hot spots. Thus, the back surface 104 may comprise a diffuse white reflector such as a microcellular polyethylene terephthalate (MCPET) material or a DuPont/

WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow, "BSY") light to yield a white light output. A diffuse reflective coating may eliminate the need for additional spatial color-mixing schemes that can introduce lossy elements into the system; although, in some embodiments it may be desirable to use a diffuse luminous surface in combination with other diffusive elements. In some embodiments, the luminous surface may be coated with a phosphor material that converts the wavelength of at least some of the light from the light emitting diodes to achieve a light output of the desired color point.

By using a diffuse white reflective material for the back surface 104 and by positioning the light sources to emit first toward the back surface 104, either directly or indirectly, several design goals are achieved. For example, the back surface 104 performs a color-mixing function, significantly increasing both the mixing distance and the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers in a traditional direct view optic can be managed with much less aggressive (and lower light loss) diffusers achieving max/min ratios of 5:1, 3:1, or even 2:1.

The back surface 104 can comprise materials other than diffuse reflectors. In other embodiments, the back surface 104 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

Although it is understood that many different dimensions are possible according to design specifications, some exemplary measurements have been included in FIG. 3. In this particular embodiment, the back surface 104 spans a distance of 21 inches from edge to edge. The heat sink 108 is spaced 1¾ inches from the specular reflector 110. The fixture 100 has a depth of 4 inches, excluding extra depth needed if the optional housing is used. Thus, the fixture 100 only extends 4-4½ inches into the plenum above the ceiling plane, giving it a shallow profile. In other embodiments, the fixture can have a greater depth or a shallower depth. Using a specular reflector to distribute the light to the luminous surface allows for a shallower fixture profile than would be possible with traditional distribution means. The back surface 104 extends far enough such that when the fixture 100 is mounted in a ceiling, the heat sink is flush with the ceiling plane or, in other embodiments, only slightly recessed above the ceiling plane.

Figure 4:
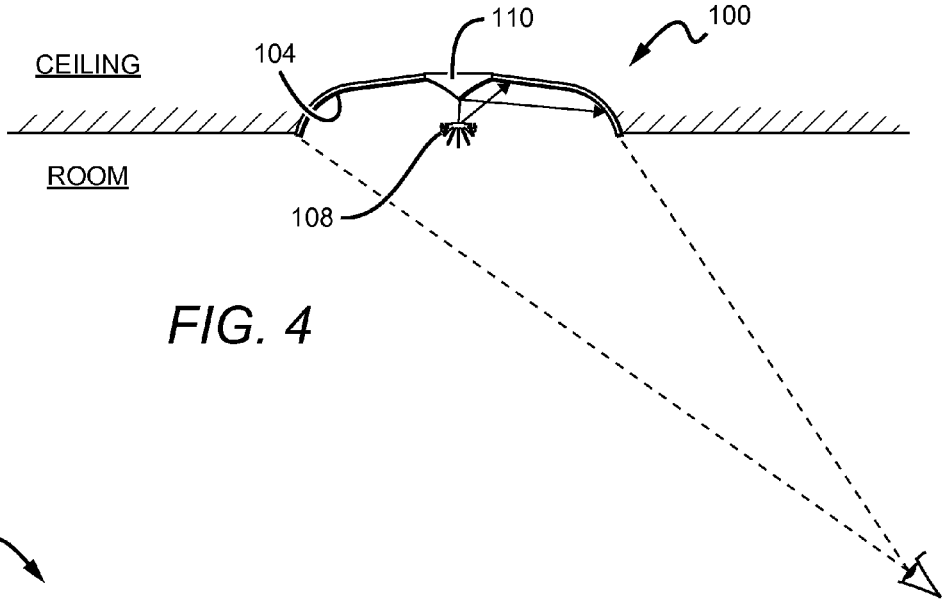
FIG. 4 is a cross-sectional view of a lighting fixture according to an embodiment of the present invention mounted in a ceiling above a room.

FIG. 4 shows a cross-sectional view of the lighting fixture 100 mounted in a ceiling above a room. Because lighting fixtures are traditionally used in large areas populated with modular furniture, such as in an office for example, many fixtures can be seen from anywhere in the room. Specification grade fixtures often include mechanical shielding in order to effectively hide the light source from the observer, providing a "quiet ceiling" and a more comfortable work environment.

Because human eyes are sensitive to light contrast, it is generally desirable to provide a gradual reveal of the brightness from the fixture 100 as an individual walks through a lighted room and to obscure direct images of the light sources. This particular embodiment is designed to reduce unpleasant glare that would otherwise be visible to observers in the lighted room area. The heat sink 108 and the specular reflector 110 are shaped and arranged relative to one another such that none of the light reflected by the specular reflector 110 is directly visible in the lighted area. Due to the design of the fixture, the light rays reflected by the specular reflector 110 will be mechanically cut off from the room by the back surface 104; thus, direct images of the light source will not be visible to observers moving about the room area.

In some embodiments, the shape and arrangement of the heat sink 108 and the back surface 104 may be adjusted dynamically either during installation or afterwards to tweak the output profile in the field. For example, an adjustment mechanism, such as a knob or a slide, can be used to adjust the angle of the surfaces of the specular reflector 104. It would also be possible to dynamically adjust the spacing between the back surface 104 and the heat sink 108 by simple mechanical means. For example, in the embodiment shown in FIG. 4, there is a lower portion of the back surface 104 that does receive any light reflected from the specular reflector. Thus, after the fixture 100 is installed, the angle of the specular reflector 110 might be widened so that the back surface 104 is painted with the reflected light right out to the edge while still maintaining the mechanical cut off.

Figure 5:
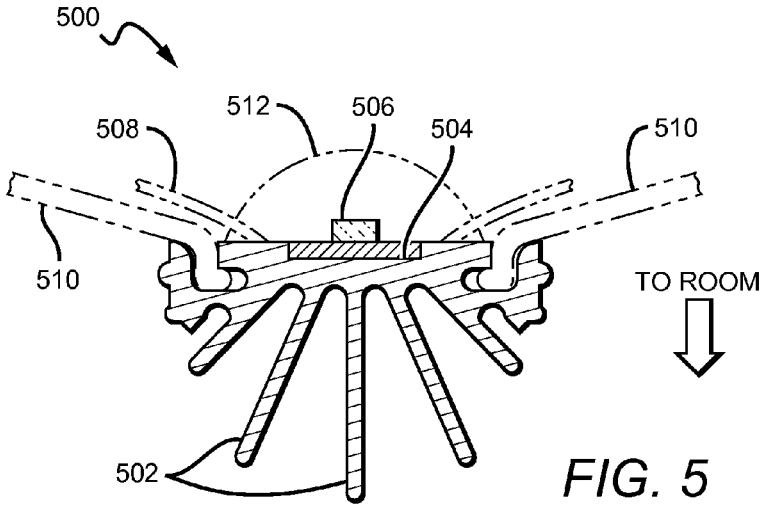
FIG. 5 is a close-up cross-sectional view of an elongated heat sink that may be used in embodiments of the present invention.

FIG. 5 is a close-up cross-sectional view of an elongated heat sink 500 that may be used in embodiments of the present invention. The heat sink 500 comprises fin structures 502 on the bottom side (i.e., the room side). Although it is understood that many different heat sink structures may be used. The top side portion of the heat sink 500 which faces the specular reflector 110 comprises a mount surface 504. The mount surface 504 provides a substantially flat area on which light sources 506 such as LEDs, for example, can be mounted. The sources 506 can be mounted orthogonally to the mount surface 504 to face the center region of the specular reflector 110, or in other embodiments, they may be angled to face other portions of the specular reflector 110 and/or back surface 104.

In this embodiment, the heat sink 500 is exposed to the ambient environment. This structure is advantageous for several reasons. For example, air temperature in a typical residential or commercial room is much cooler than the air above the fixture (or the ceiling if the fixture is mounted above the ceiling plane). The air beneath the fixture is cooler because the room environment must be comfortable for occupants; whereas in the space above the fixture, cooler air temperatures are much less important. Additionally, room air is normally circulated, either by occupants moving through the room or by air conditioning. The movement of air throughout the room helps to break the boundary layer, facilitating thermal dissipation from the heat sink 500. Also, in ceiling-mounted embodiments, a room-side heat sink configuration prevents improper installation of insulation on top of the heat sink as is possible with typical solid state lighting applications in which the heat sink is disposed on the ceiling-side. This guard against improper installation can eliminate a potential fire hazard.

The heat sink 500 can be constructed using many different thermally conductive materials. For example, the heat sink 500 may comprise an aluminum body. The heat sink 500 can be extruded for efficient, cost-effective production and convenient scalability.

Some additional optional elements of the heat sink 500 are shown in phantom in FIG. 5. In some embodiments, an optional baffle 508 may be included. The baffle 508 reduces the amount of light emitted from the sources 506 at high angles. In some configurations, this may help to prevent visible hot spots or color spots at high viewing angles. In other embodiments, the heat sink 500 may be adjoined with lens plates 510 (discussed in more detail herein) that extend from the heat sink 500 out to a luminous surface, for example. In still other embodiments, the light sources 506 may be covered by an optional transmissive cover 512. The cover 512 may function as a lens to shape/convert the light as it emanates from the source 506 but before it interacts with the specular reflector 110 or the heat sink 108. The cover may also function as a flame barrier (e.g., glass or a UL94 5VA rated transparent plastic) which is required to cover the high voltage LEDs if they are used as the source. Any of these optional elements or any combination of these elements may be used in heat sinks designed for embodiments of the lighting fixtures disclosed herein.

The heat sink mount surface 504 provides a substantially flat area on which one or more light sources can be mounted. In some embodiments, the light sources will be pre-mounted on light strips. FIGS. 6*a-c* show a top plan view of portions of several light strips 600, 620, 640 that may be used to mount multiple LEDs to the mount surface 504. Although LEDs are used as the light sources in various embodiments described herein, it is understood that other light sources, such as laser diodes for example, may be substituted in as the light sources in other embodiments of the present invention.

Many industrial, commercial, and residential applications call for white light sources. The lighting fixture 100 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 600, 620, 640 each represent possible LED combinations that result in an output spectrum that can be mixed to generate white light. Each lighting strip can include the electronics and interconnections necessary to power the LEDs. In some embodiments the lighting strip comprises a PCB with the LEDs mounted and interconnected thereon. The lighting strip 600 includes clusters 602 of discrete LEDs, with each LED within the cluster 602 spaced a distance from the next LED, and each cluster 602 spaced a distance from the next cluster 602. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 6*a* uses a series of clusters 602 having two blue-shifted-yellow LEDs ("BSY") and a single red LED ("R"). Once properly mixed the resultant output light will have a "warm white" appearance.

The lighting strip 620 includes clusters 622 of discrete LEDs. The scheme shown in FIG. 6*b* uses a series of clusters 622 having three BSY LEDs and a single red LED. This scheme will also yield a warm white output when sufficiently mixed.

The lighting strip 640 includes clusters 642 of discrete LEDs. The scheme shown in FIG. 6*c* uses a series of clusters 642 having two BSY LEDs and two red LEDs. This scheme will also yield a warm white output when sufficiently mixed.

The lighting schemes shown in FIGS. 6*a-c* are meant to be exemplary. Thus, it is understood that many different LED combinations can be used in concert with known conversion techniques to generate a desired output light color.

Figure 7A:
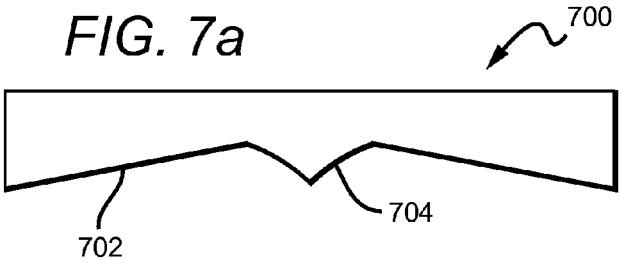
FIGS. 7*a-d* are cross-sectional views of various shapes of luminous surfaces that may be used in embodiments of the present invention.
Figure 7B:
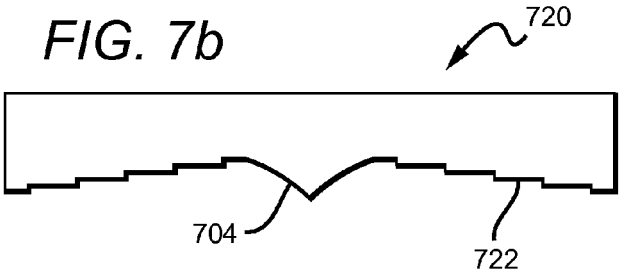
Figure 7C:
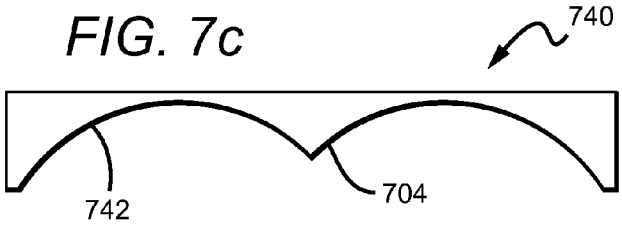
Figure 7D:
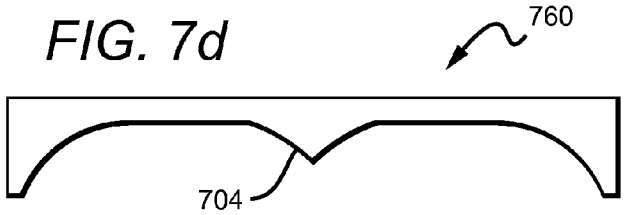

The back surface 104 in the fixture 100 includes side regions 412 having a curved shape that is parabolic at the ends; however, many other shapes are possible. FIGS. 7*a-d* are cross-sectional views of various shapes of luminous surfaces. The surface 700 of FIG. 7*a* features flat side regions 702 on either side of the specular reflector 704. FIG. 7*b* features corrugated or stair-step side regions 722. The step size and the distance between steps can vary depending on the intended output profile. In some embodiments the corrugation may be implemented on a microscopic scale. FIG. 7*c* shows a luminous surface 740 having parabolic side regions 742. FIG. 7*d* shows a luminous surface 760 having a curvilinear contour. It is understood that geometries of the back reflectors 700, 720, 740, 760 are exemplary, and that many other shapes and combinations of shapes are possible. The shape of the luminous surface should be chosen to produce the appropriate output profile for an intended purpose.

Figure 8:
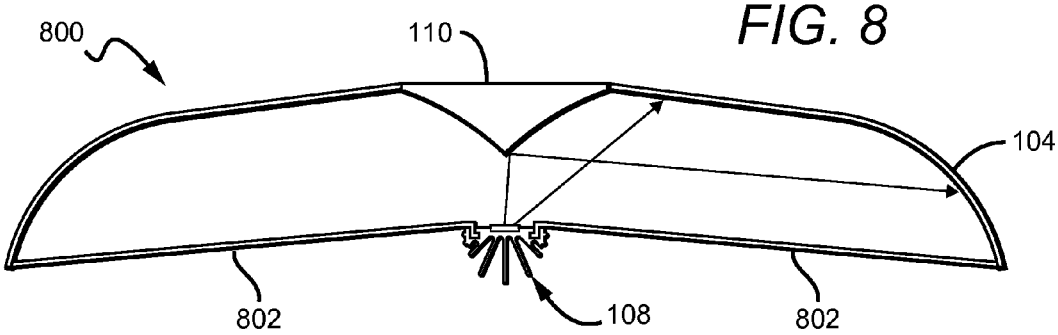
FIG. 8 is a cross-sectional view of a light fixture according to an embodiment of the present invention.

FIG. 8 is a cross-sectional view of another light fixture 800 according to an embodiment of the present invention. This fixture 800 contains similar elements as fixture 100; like elements retain their reference numerals throughout. This particular embodiment comprises lens plates 802 extending from the heat sink 108 out to the back surface 104. The lens plates 802 can comprise many different elements and materials.

In one embodiment, along with providing protection to the internal elements from dust and the like, the lens plates 802 can comprise a diffusive element. Diffusive lens plates function in several ways. For example, they can provide additional mixing of the outgoing light to achieve a visually pleasing uniform source. However, a diffusive lens plate can introduce additional optical loss into the system. Thus, in embodiments where the light is sufficiently mixed by the back surface 104 or by other elements, a diffusive lens plate may be unnecessary. In such embodiments, a transparent glass lens plate may be used, or the lens plates may be removed entirely. In still other embodiments, scattering particles may be included in the lens plates 802. In embodiments using a specular luminous surface, it may be desirable to use a diffuse lens plate.

Diffusive elements in the lens plates 802 can be achieved with several different structures. A diffusive film inlay can be applied to the top- or bottom-side surface of the lens plates 802. It is also possible to manufacture the lens plates 802 to include an integral diffusive layer, such as by coextruding the two materials or insert molding the diffuser onto the exterior or interior surface. A clear lens may include a diffractive or repeated geometric pattern rolled into an extrusion or molded into the surface at the time of manufacture. In another embodiment, the lens plate material itself may comprise a volumetric diffuser, such as an added colorant or particles having a different index of refraction, for example.

In other embodiments, the lens plates 802 may be used to optically shape the outgoing beam with the use of microlens structures, for example. Many different kinds of beam shaping optical features can be included integrally with the lens plates 802.

FIG. 9 is a cross-sectional view of a lighting fixture 900 according to an embodiment of the present invention. This particular fixture 900 is designed to function as a "wall-washer" type fixture. In some cases, it is desirable to light the area of a wall with higher intensity than the lighting in the rest of the room, for example, in an art gallery. The fixture 900 is designed to directionally light an area to one side. Thus, the fixture 900 is asymmetrical. An elongated heat sink 108 is disposed proximate to a spine region of an asymmetrical specular reflector 902. This embodiment may include a lens plate 904 to improve color mixing and output uniformity. The inner structure of the fixture 900 is similar to the inner structure of either half of the fixture 100. The light sources 906 are mounted to the back side of the heat sink 108. The sources 906 emit toward the specular reflector 902 where the light is reflected toward the luminous surface 908 and then out through lens plate 904. Thus, the fixture 900 comprises an asymmetrical structure to provide the directional emission to one side of the spine region. Many of the elements discussed in relation to the symmetrical embodiments disclosed herein can be used in an asymmetrical embodiment, such as the fixture 900. It is understood that the fixture 900 is merely one example of an asymmetrical arrangement and that many variations are possible to achieve a particular directional output.

Figure 10:
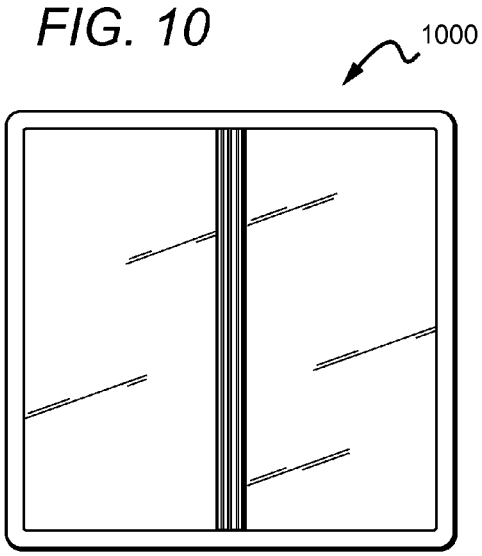
FIG. 10 is a bottom view of a fixture according to an embodiment of the present invention.
Figure 11:
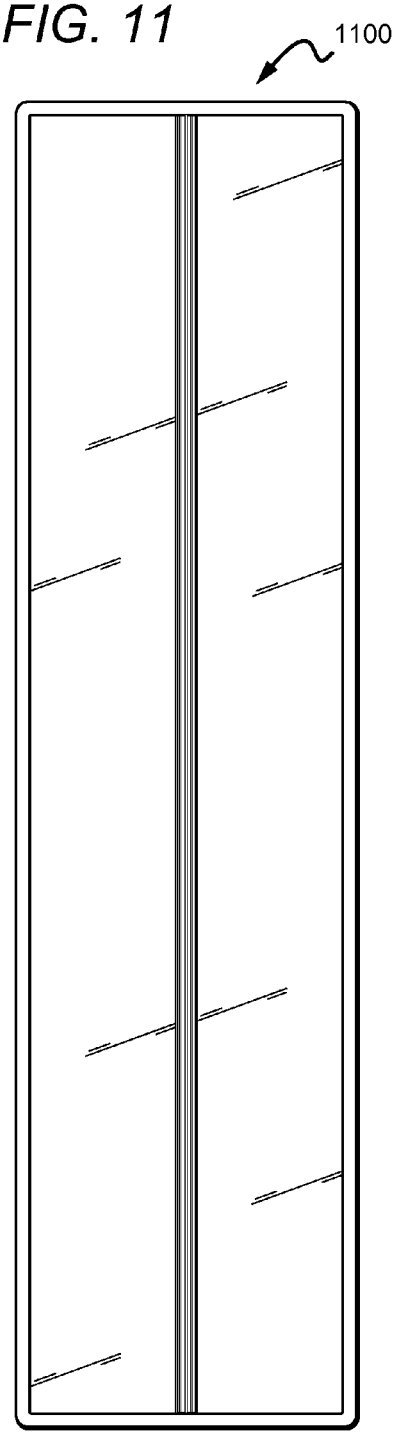
FIG. 11 is a bottom view of a fixture according to an embodiment of the present invention.
Figure 12:
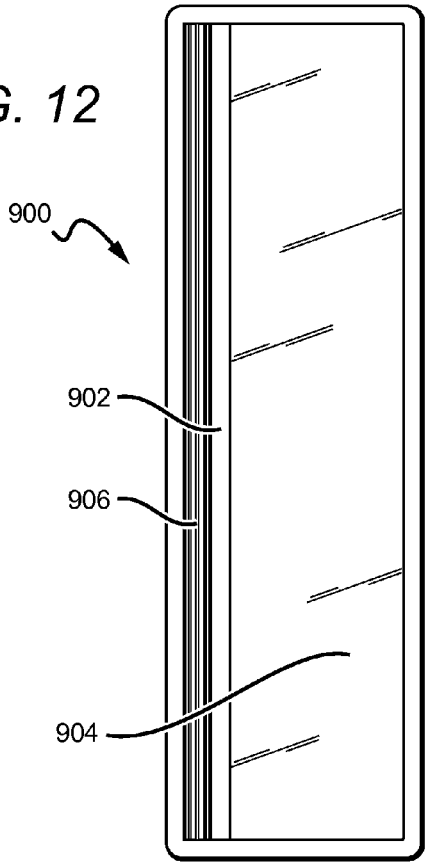
FIG. 12 is a bottom view of a wall-washer type fixture according to an embodiment of the present invention.

Fixtures according to embodiments of the present invention can have many different sizes and aspect ratios. FIG. 10 is a bottom view of a fixture 1000 according to an embodiment of the present invention. This particular fixture 1000 has an aspect ratio (length to width) of 1:1. It has square dimensions. FIG. 11 is a bottom view of another fixture 1100 according to an embodiment of the present invention. The fixture 1100 has an aspect ratio of 4:1. FIG. 12 is a bottom view of the wall-washer type fixture 900. As shown, a portion of the asymmetrical specular reflector 902 can be seen through the transmissive lens plate 904. Thus, the fixture 900 should be configured such that no direct images of the sources 906 are visible in the specular reflector 902 from the lighted area. It is understood that troffers 900, 1000, 1100 are exemplary embodiments, and the disclosure should not be limited to any particular size or aspect ratio.

The arrangement of the elements in the lighting fixture 100 is merely exemplary. There are many different arrangements that may be used to achieve a particular light output profile at a luminous surface. Each arrangement functions similarly. Light is emitted from a source over a range of angles. To control the emitted light at least a portion of it is reflected by a specular reflector toward a luminous surface. The reflected light as well as some of the light that is emitted directly from the source is received at the luminous surface. The elements of the fixture are arranged such that substantially all of the reflected light is incident on the luminous surface. Thus, no images of the source on the specular reflector are directly visible to observers in the intended viewing area.

FIGS. 13*a-f* show several cross-sectional views of alternate fixture arrangements according to embodiments of the present invention.

FIG. 13*a* shows an arrangement wherein the source emits light toward a first optical element. As the light passes through the element it is redirected to a luminous surface. In some cases the luminous surface may be primarily reflective, in which case the fixture is classified as indirect view. In other cases, the luminous surface may be substantially transmissive, creating a direct view fixture. As shown, it is also possible to use a luminous surface that is partially transmissive and partially reflective whereby some of the light is redirected by the luminous surface toward the room environment and some passes through the luminous surface as "back-light" or "up-light." In the case of suspended fixtures, such an arrangement would provide some up-light for the area of the ceiling above the fixture.

FIG. 13*b* shows a pendant mounted indirect fixture. The source emits light across a range of angles. Some of the light emitted at high angles is redirected by the specular reflector cup that partially surrounds the source toward the pendant-shaped luminous surface. The luminous surface diffuses the light and redirects it out as useful emission.

FIG. 13*c* shows a pendant mounted direct fixture. Some of the light emitted from the source is reflected by the specular reflector cup that partially surrounds the source. The reflected light and light directly from the source are incident on the pendant-shaped luminous surface. However, in this embodiment, the luminous surface is transmissive, passing through a significant portion of the light as useful emission.

Figure 13D:
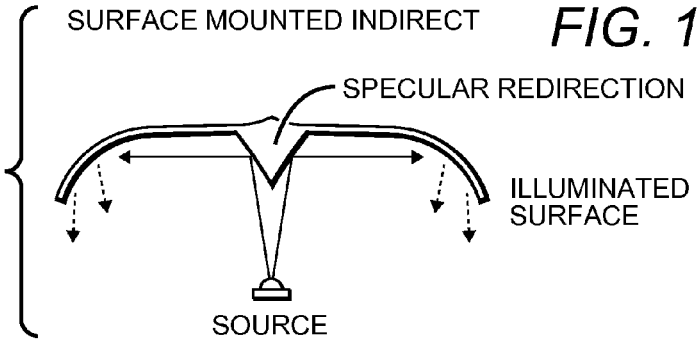

FIG. 13*d* shows a surface mounted indirect fixture similar to the arrangements of fixtures 100, 800.

Figure 13E:
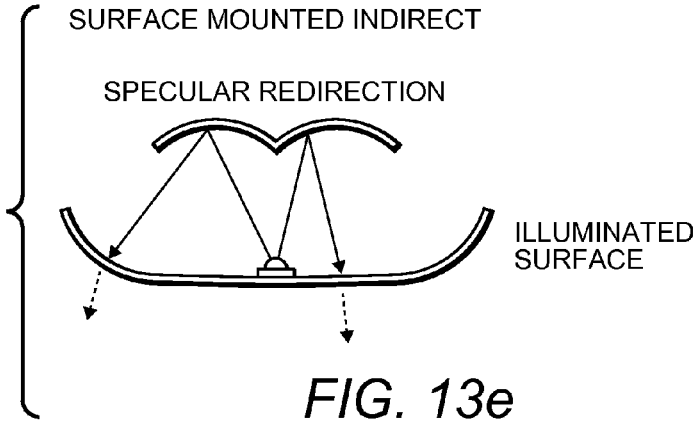

FIG. 13*e* shows a surface mounted indirect fixture. The source emits substantially all light toward the specular reflector. The specular reflector redirects the incident light in a direction back toward the source. Most of the reflected light is incident on the luminous surface which is below the source. The luminous surface is transmissive, so most of the light is refracted and passed through as useful emission.

Figure 13F:
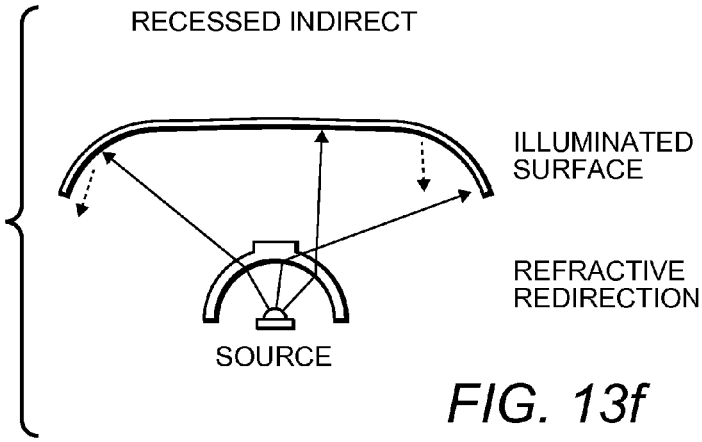

FIG. 13*f* shows a recessed indirect fixture. The source is surrounded by a refractive element. After it is emitted from the source, the light passes through the refractive element and is redirected toward the luminous surface. The luminous surface redirects the light in a direction back toward the source where is emitted as useful emission.

It is understood that embodiments of the lighting fixtures presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described herein.

We claim:

1. A lighting fixture, comprising:

an elongated heat sink comprising a mount surface;

an elongated specular reflector proximate to said mount surface, said heat sink and said specular reflector configured such that a spatial relationship is maintained between said heat sink and said specular reflector; and a back surface proximate to said elongated specular reflector.

2. The lighting fixture of claim 1, further comprising at least one cluster of light emitting diodes (LEDs) on said mount surface.

3. The lighting fixture of claim 1, further comprising at least one cluster of LEDs, each of said clusters comprising at least one red LED and at least one blue-shifted yellow (BSY) LED.

4. The lighting fixture of claim 1, said specular reflector comprising at least two parabolic reflective surfaces shaped to redirect light toward said back surface.

5. The lighting fixture of claim 1, said specular reflector comprising a metal-coated surface.

6. The lighting fixture of claim 1, said back surface comprising a diffuse reflective surface.

7. The lighting fixture of claim 1, further comprising at least one light source on said mount surface.

8. The lighting fixture of claim 7, said back surface shaped to receive light redirected from said specular reflector and light emitted directly from said light source such that substantially all light emitted from said light source impinges on said back surface.

9. The lighting fixture of claim 7, further comprising a lens over said at least one light source on said mount surface.

10. The lighting fixture of claim 7, further comprising a flame barrier over said at least one light source on said mount surface.

11. The lighting fixture of claim 1, wherein said back surface is at least partially light transmissive.

12. The lighting fixture of claim 1, said back surface comprising a curved shape.

13. The lighting fixture of claim 1, said back surface comprising a corrugated shape.

14. The lighting fixture of claim 1, said back surface comprising a faceted surface.

15. A lighting fixture, comprising:

an elongated heat sink comprising a mount surface;

an elongated specular reflector proximate to said mount surface, said heat sink and said specular reflector configured such that a spatial relationship is maintained between said heat sink and said specular reflector;

a back surface proximate to said elongated specular reflector; and a lens plate extending from said heat sink to said back surface.

16. The lighting fixture of claim 1, further comprising at least one end piece to which the ends of said heat sink and said specular reflector are mounted.

17. The lighting fixture of claim 1, said back surface extending from both lateral sides of said elongated specular reflector.

18. A lighting assembly, comprising:

a protective housing comprising at least one end piece and a back surface;

an elongated heat sink mounted to said at least one end piece, said heat sink comprising a mount surface;

an elongated specular reflector on said back surface, such that a spatial relationship is established between said specular reflector and said heat sink;

at least one light source on said mount surface; and a control circuit for controlling said at least one light source.

19. The lighting assembly of claim 18, said at least one light source comprising at least one cluster of light emitting diodes (LEDs) on said mount surface.

20. The lighting assembly of claim 18, said at least one light source comprising at least one cluster of LEDs, each of said clusters comprising at least one red LED and at least one blue-shifted yellow (BSY) LED.

21. The lighting assembly of claim 18, said specular reflector comprising at least two parabolic reflective surfaces shaped to redirect light toward said back surface.

22. The lighting assembly of claim 18, said specular reflector comprising a metal-coated surface.

23. The lighting assembly of claim 18, said back surface comprising a diffuse reflective surface.

24. The lighting assembly of claim 18, further comprising a lens over said at least one light source on said mount surface.

25. The lighting assembly of claim 18, further comprising a flame barrier over said at least one light source on said mount surface.

26. The lighting assembly of claim 18, wherein said back surface is at least partially light transmissive.

27. The lighting assembly of claim 18, said back surface comprising a curved shape.

28. The lighting assembly of claim 18, said back surface comprising a corrugated shape.

29. The lighting assembly of claim 18, said back surface comprising a faceted surface.

30. The lighting assembly of claim 18, further comprising a lens plate extending from said heat sink to said back surface.

31. A method of lighting a surface:

emitting light from a light source over a range of angles;

redirecting at least a portion of said light with a specular reflector toward a luminous surface;

receiving light directly from said light source and from said specular reflector at said luminous surface; and mechanically obscuring images of said light source on said specular reflector from a viewing area.

* * * * *